United States Patent [19]

Kirsch

[11] Patent Number: 4,642,897

[45] Date of Patent: Feb. 17, 1987

[54] METHOD AND APPARATUS FOR MARKING WORKPIECES

[75] Inventor: Hans-Peter Kirsch, Schafbrucke, Fed. Rep. of Germany

[73] Assignee: Mauser-Werke Oberndorf GmbH, Fed. Rep. of Germany

[21] Appl. No.: 681,942

[22] Filed: Dec. 14, 1984

[30] Foreign Application Priority Data

Dec. 16, 1983 [DE] Fed. Rep. of Germany ..... 3345525

[51] Int. Cl.[4] ..... B43L 13/00

[52] U.S. Cl. ..... 33/18.1; 33/23.11

[58] Field of Search ..... 33/23 R, 23 H, 23 G, 33/23 C, 1 M, 18.1; 346/162, 163, 139 C

[56] References Cited

U.S. PATENT DOCUMENTS

| | | | |
|---|---|---|---|
| 1,787,761 | 1/1931 | Pomplum et al. | 33/23.11 |
| 1,825,551 | 9/1931 | Serrell | 346/163 X |
| 2,976,613 | 3/1961 | Shields | 33/23.11 |
| 3,119,919 | 1/1964 | Pratt | 346/163 X |
| 4,104,648 | 8/1978 | Blumenthal | 33/23 C X |

*Primary Examiner*—Harry N. Haroian

*Attorney, Agent, or Firm*—McGlew and Tuttle

[57] ABSTRACT

A method for the marking of workpieces and a device for the execution of the method, uses a probe intended for multicoordinate measuring machines and having a chuck for tracer pins. A scriber is inserted in the probe which is connected to a voltage source so that a voltage prevails between the scriber tip and workpiece surface and a fine line is drawn due to the burn-off through voltage spark-over and current flow.

4 Claims, 3 Drawing Figures

METHOD AND APPARATUS FOR MARKING WORKPIECES

FIELD AND BACKGROUND OF THE INVENTION

The invention relates to a method for marking workpieces and to a device to execute the method, using a probe intended for measuring machines, particularly multicoordinate measuring machines and particularly a measuring probe with a chuck for one or several tracer pins.

Marking machines are already known which are similar in their mechanical design to the three-coordinate measuring machines. However, in their overall construction, such marking machines are considerably more simple and rugged than the measuring machines because, basically, marking requires less accuracy than measuring.

For instance, the marking machine can absorb without problems the forces occurring in marking whereas themeasuring machine, due to its mechanical construction and its application, is not suited therefor.

Since the workpieces to be marked often differ greatly from each other as rough parts according to the respective manufacturing process and the marking operation is geared to desired values, the possibility to operate marking machines by the NC method is very remote. The tool, e.g. a scriber, is normally connected to the chuck and the overall mechanism of the marking machine. The latter is fed to the workpiece in accordance with the given control data.

But the scriber does not detect the workpiece contour and therefore travels with increased force over material accumulations.

The essential disadvantages of the known marking machine are:

- they are suited exclusively for the marking of simple geometric elements such as circles and straight lines;
- due to the machine design, the accuracy attainable is relatively poor;
- the wear of the scriber is relatively great;
- the workpieces to be scribed must be aligned mechanically; and
- automatic marking is possible only with restrictions because the machine is not controlled by the workpiece.

The three coordinate measuring machines, suited per se for marking from the aspect of their precision, are not usable, however, for the reason that they offer no possibility of absorbing forces and that they can handle only small tool weights due to the measured value pickup system present.

SUMMARY OF THE INVENTION

The invention provides a method for the marking of workpieces which avoids the above mentioned disadvantages of the conventional marking machines and which is easy to execute while permitting the marking of any configurations with great accuracy. It is also an object of the invention to provide a mechanically simply designed device for the execution of the method.

According to the invention, these problems are solved in that a voltage is applied to a scriber and that the scriber, as it moves across the surface of the workpiece, draws a line thereon through burning by means of voltage spark-over and current flow between the tip of the scriber and the surface of the workpiece. The tip of the scriber may be inserted in a measuring probe of a multicoordinate measuring machine, with the interposition of an electrical insulation between it and the probe.

The advantage of this marking method is contactless, low-force marking of lines on workpiece surfaces. It is optional to apply an AC or DC voltage to the scriber tip. The strength of the line made is essentially a function of the current set, of the quality of the scriber tip, and of the position of the scriber tip relative to the surface normal. The device for the execution of the method, using a probe intended for multicoordinate measuring machines, provides, according to the invention, that there be inserted in the probe a pin whose scriber tip, electrically insulated against the probe, is connected to a voltage source in such a manner that the scriber tip carries a potential; and a voltage is present between scriber tip and workpiece surface. The scriber tip may be connected to an AC-fed voltage source which may again be turned on and off by a switch. Advantageously, there is between the scriber tip and the workpiece surface facing it a constant air gap of 0.1 to 0.5 mm.

This device according to the invention makes contactless marking possible in a technically simple manner. Since the scriber tip is connected to a voltage source, a fine arc is drawn between the scriber tip and the workpiece surface of the part to be marked when a voltage is applied, generating a thin line equivalent to a mechanically scribed line. The characteristic typical of the probe of the three-coordinate measuring machine permits the maintenance of contact between scriber tip and workpiece due to the readjustment behavior, even in the event of surface deviations. The three-coordinate measuring machine, thus used as a marking machine, controls the scriber tip through the coordinates known to it. The tip is defined through the known calibration by means of a prepared auxiliary calibrating ball or by the tip setting procedure by means of a calibrating cube with holes. The strength of the line made is essentially a function of the current set, of the quality of the scriber tip and of the position of the tip relative to the surface normal. The surface quality and the material to be marked also affect the durability of the scriber tip. This means that workpieces with poor surfaces, such surfaces as rolled, or with hammer impressions, etc., require high marking currents. Where long marking lines are involved, there also results under these conditions increased burning of the scriber tip, automatically leading to a broadening of the line made.

To counteract this wear and at the same time provide a good possibility to replace the scriber tip quickly, the tip is made of metal, preferably tungsten, and retained in an axial hole in the pin by a cross pin, or a cross screw, according to a further development of the invention.

The pin is separated in its area facing the probe and both mutually and coaxially facing ends may be joined to each other by an interposed adapter of electrically insulating material. The advantage of this design is that both the probe and the marking machine are electrically insulated against the scriber tip, thereby preventing basically in particular personal injury through electrical shock.

In another embodiment of the invention, the scriber tip may be disposed axially movable within a coil connected to a voltage source reduced to low voltage by a transformer, the scriber tip working at an impressed frequency on the workpiece surface due to the action of a compression spring. The advantage of this design is, first, that only a low voltage gets to the scriber tip, which excludes personal injury alsop when the scriber tip is touched unintentionally. When voltage is applied, a current transfer from the scriber tip to the workpiece surface takes place. At the same time, to coil generates an electrical field through which the scriber point is lifted off perpendicularly from the workpiece surface against the force of the spring. This motion of the scriber tip is immediately reversed by the marking of the arc. This mechanical resonant circuit thus realized causes a line composed of dots to be drawn on a workpiece surface when the probe is moved across it. At an appropriately high frequency of 50 Hz to about 200 Hz a solid line may appear also.

In further developments of the invention, the scriber tip may be made of a ceramic material and have an axial hole to guide a thin wire which exits at the tip and is connected to a voltage source so that the wire end carries a potential and a voltage prevails between the end of the wire and the workpiece surface disposed with spacing. The wire may be refed automatically in accordance with its burn-off rate. In this embodiment of the invention an electrically insulating ceramic tip is utilized which is retained spaced from the workpiece surface. A line is drawn on the workpiece surface due to the burning of the inserted wire whose end carries a potential, leading to a spark-over at the voltage applied between the wire and the workpiece surface.

In all cases of marking there is a burn-out of the surface with very shallow depth.

Accordingly, it is an object of the invention to provide an improved method for the marking of workpieces using a scriber tip which comprises applying a voltage to the scriber tip as it is moved across a workpiece surface so that it causes a line to be drawn thereon due to the burning produced by the voltage spark-over and current flow between the scriber tip and the workpiece surface.

A further object of the invention is to provide a device for the execution of the method for marking workpieces using a probe intended for measuring machines and in particular a multicoordinate measuring machine and comprising a measuring probe having a tracer pin chuck with a pin in the chuck having a scriber tip and with means electrically insulating the tip from the probe and including a voltage source connected to the tip in such a manner that the scriber tip carries a potential and a voltage prevails between the scriber tip and the workpiece.

A further object of the invention is to provide a simple and easy and inexpensive method for marking workpieces and to a new and useful device for accomplishing the method which is simple in design, rugged in construction and economical to manufacture.

The various features of novlety which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
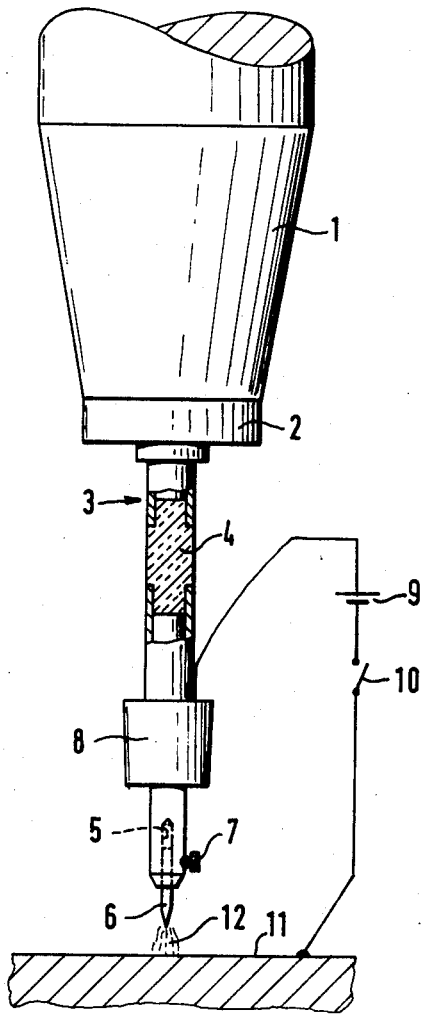
FIG. 1 is an elevational view of a scriber in a probe, partly in section and constructed in accordance with the invention.

Referring to the drawings in particular in accordance with the invention a method for marking a workpiece uses a scriber tip 6 and it comprises applying a voltage to the scriber tip, for example from a voltage source 9 using a circuit which is connected to the tip and to a workpiece of surface 11. The voltage is applied as the tip 6 is moved across the workpiece surface so that it causes a line to be drawn on the surface due to the burning effected by the voltage spark-over and current flow between the scriber tip and the workpiece surface.

Shown in FIG. 1 is the lower part of a measuring probe 1, as usually employed in three-coordinate measuring machines. Clamped in chuck 2 of probe 1 is a pin 3 in coaxial extension of the probe. Th pin 3 is separated in its upper area and consequently consists of two parts. Inserted between the two parts of pin 3 is an adapter 4 of electricity insulating material. The lower part of pin 3 has an axial hole 5, into which the scriber tip 6, such as of tungsten, is inserted from below. The scriber tip 6 is kept in place by a transversely inserted screw 7. The central part 8 of pin 3 is connected to a voltage source 9. In the embodiment example according to FIG. 1, a DC voltage source 9 is shown. Also provided is a switch 10, by means of which the voltage can be turned on and off. When the switch 10 is closed, the scriber tip 6 carries a potential. Since the workpiece surface is also connected to the voltage source, a voltage prevails between the marking tip 6 and the workpiece surface 11. The scriber tip 6 is constantly at a defined spacing from the workpiece surface 11 so that an air gap 12 exists between workpiece 11 and scriber tip 6. A current spark-over now occurs between the scriber tip 6 and the workpiece surface 11, which leads to a low depth burn-out of the workpiece surface. If the probe 1 is simultaneously moved transversely, a thin marking line will appear on the workpiece surface 11 according to given machine data.

Figure 2:
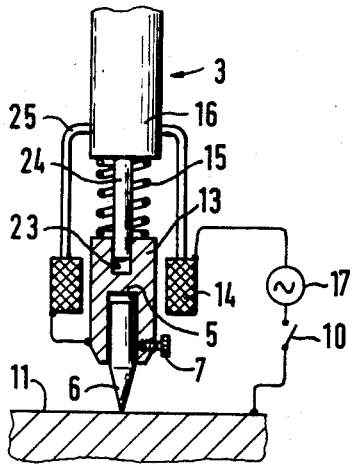
FIG. 2 is a view similar to FIG. 1 of another embodiment of the invention showing the scriber tip disposed axially movable in a coil.

The embodiment example according to FIG. 2 shows a solution with a low voltage of about 10 to 12 V. This is achieved with an AC source by the interposition of a transformer. The lower part 13 of a pin 3, or its central part 8, is disposed axially movable in the center of a coil 14. Again, the scriber tip 6 is inserted into an axial hole 5 in the lower part. The top of the lower part of pin 3 is acted upon by a compression spring 15 supported by the upper part 16 of the pin. The compression spring 15 causes the scriber tip 6 to rest on the workpiece surface 11. Now, the coil 4 is connected to the AC voltage source 17 on the one hand and to the lower part 13 of pin 3 on the other. Due to the simultaneous electrical connection of the workpiece surface 11 to the voltage source 17, a voltage is applied in the operating state between the scriber tip 6 and the workpiece surface 11.

If the scriber tip 6 is now caused to contact the workpiece surface 11, the potential at the scriber tip 6 collapses and and the voltage applied to the coil 14 generates in known manner, a magentic field with the current flowing through, with the consequence that the lower part 13 of pin 3 moves upwardly against the force of the compression spring 15, thereby lifting the scriber tip 6 off the workpiece surface 11. This interrupts the current flow between the scriber tip 6 and the workpiece surface 11 with the consequence that the lower part 13 of pin 3, together with the scriber tip 6, pushed back onto the workpiece surface 11 again by the compression spring 15. This process repeats when voltage is applied at an impressed frequency which may be between 50 and 200 Hz. If the probe together with the pin 3 and the scriber tip 6 is moved transversely across a workpiece surface 11, a marking line is generated on it. The coil 4 in FIG. 4 is joined mechanically to the pin 3 by a yoke 25. To produce an axial motion of the lower pin part 13 relative to the pin 3, a bolt 24 is attached axially to the pin 3 which immerses centrally through the spring 15 into a recess 23 on the face of the lower pin part 13.

Figure 3:
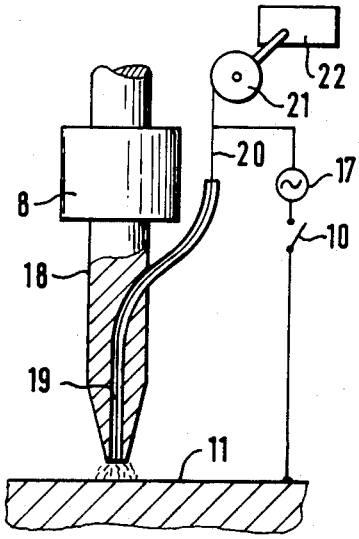
FIG. 3 is a view similar to FIG. 1 of still another embodiment of the invention showing a ceramic tip of different design with inserted wire.

In FIG. 3, the scriber tip 18 is designed as a guide tip of a ceramic material, into which is machined an axial hole 19 with lateral exit. Inserted in this hole is a very thin wire about 2 to 3 one hundredth of a millimeter in diameter. The wire 20 ends approximately flush with the guide tip 18 which ends a slight distance above the workpiece surface 11. In the embodiment example according to FIG. 3, a voltage is again applied to the thin wire 20 so that a potential prevails between the wire end 20 and the workpiece surface 11. The voltage source 17 can be turned on and off by a switch 10. Since in operating condition the thin wire will burn off at the guide tip 19, the wire 20 is automatically refed, e.g. from a spool 21 by a motor 22.

While specific embodiments of the invention have been shown and described in detail to illustrate the application of the principles of the invention, it will be understood that the invention may be embodied otherwise without departing from such principles.

What is claimed is:

1. A device for effecting the marking of workpieces when using a probe intended for measuring machines and in particular using a multicoordinate measuring machine, comprising a measuring probe having a tracer pin chuck, a pin in said chuck having a scriber tip, means electrically insulating said scriber tip from said probe, a voltage source connected to said tip in such a manner that said scriber tip carries a potential and a voltage prevails between said scriber tip and the workpiece surface, said scriber tip being made of a ceramic material having an axial hole, a thin wire extending through said hole exiting at the tip of said scriber tip and being connected to said voltage source so that said wire carries a potential and a voltage exists between the wire and the workpiece surface and means for feeding the wire to said tip at a rate comparable to the burn-off of said wire.

2. Device for effecting the marking of workpieces when using a probe intended for measuring machines and in particular using a multicoordinate measuring machine, comprising a measuring probe having a tracer pin chuck, a tracer pin in said chuck having a scriber tip, means electrically insulating said scriber tip from said probe, and a voltage source connected to said scriber tip in such a manner that said scriber tip carries a potential and a voltage prevails between said scriber tip and the workpiece surface, said tracer pin including an intermediate adapter portion of electrically insulating material.

3. Device for effecting the marking of workpieces when using a probe intended for measuring machines and in particular using a multicoordinate measuring machine, comprising a measuring probe having a tracer pin chuck, a tracer pin in said chuck having a scriber tip, means electrically insulating said scriber tip from said probe, and a voltage source connected to said scriber tip in such a manner that said scriber tip carries a potential and a voltage prevails between said scriber tip and the workpiece surface, said tracer pin including a lower portion separated from an upper portion, a guide pin extending from said upper portion into said lower portion guiding said lower portion upwardly and downwardly and a magnetic coil carried by said upper portion disposed around said lower portion, said voltage source being connected to said coil so that when it is energized, said lower portion moves upwardly towards said upper portion, said voltage source including a transformer for reducing the voltage to said coil and applying a voltage acting on said scriber tip at an impressed frequency of at least 50 Hz, and a compression spring disposed between said lower portion and said upper portion biasing said lower portion downwardly and wherein said coil when energized overcomes the downward bias of said spring.

4. Device for effecting the marking of workpieces when using a probe intended for measuring machines and in particular using a multicoordinate measuring machine, comprising a measuring probe having a tracer pin chuck, a tracer pin in said chuck having a scriber tip, means electrically insulating said scriber tip from said probe, and a voltage source connected to said scriber tip in such a manner that said scriber tip carries a potential and a voltage prevails between said scriber tip and the workpiece surface, said scriber tip being made of a ceramic material having an axial hole, a thin wire extending through said hole exiting at the tip of said scriber tip and being connected to said voltage source so that said wire carries a potential and a voltage exists between the wire and the workpiece surface.

* * * * *